US007810911B2

(12) United States Patent
Shim et al.

(10) Patent No.: US 7,810,911 B2
(45) Date of Patent: Oct. 12, 2010

(54) THERMAL INKJET PRINTHEAD

(75) Inventors: Dong-sik Shim, Yongin-si (KR); Yong-seop Yoon, Yongin-si (KR); Moon-chul Lee, Yongin-si (KR); Yong-won Jeong, Yongin-si (KR); Hyung Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 833 days.

(21) Appl. No.: 11/742,816

(22) Filed: May 1, 2007

(65) Prior Publication Data

US 2008/0106578 A1 May 8, 2008

(30) Foreign Application Priority Data

Nov. 2, 2006 (KR) ..... 10-2006-0107931

(51) Int. Cl.
*B41J 2/05* (2006.01)

(52) U.S. Cl. ..... 347/61; 347/58

(58) Field of Classification Search ..... 347/61, 347/62–65, 50, 54, 56, 58, 44, 20
See application file for complete search history.

(56) References Cited

U.S. PATENT DOCUMENTS

| | | | | |
|---|---|---|---|---|
| 6,616,269 | B2 * | 9/2003 | Nozawa | 347/58 |
| 7,188,931 | B2 * | 3/2007 | Cabal et al. | 347/54 |
| 2003/0193545 | A1 * | 10/2003 | Boucher et al. | 347/50 |
| 2007/0211115 | A1 * | 9/2007 | Ibe et al. | 347/58 |

* cited by examiner

*Primary Examiner*—K. Feggins
(74) *Attorney, Agent, or Firm*—Stanzione & Kim, LLP

(57) ABSTRACT

A thermal inkjet printhead includes a plurality of bonding pads to which an external voltage is applied, a plurality of common wires connected to the each of the bonding pads, respectively, a plurality of individual wires connected to each of the common wires, respectively, and heaters connected to each of the individual wires, respectively, to generate ink bubbles by heating ink, wherein each of the common wires includes a first metal layer and a first metal bump which are formed on the first metal layer.

19 Claims, 6 Drawing Sheets

THERMAL INKJET PRINTHEAD

CROSS-REFERENCE TO RELATED APPLICATIONS

This application claims priority under 35 U.S.C. §119(a) from Korean Patent Application No. 10-2006-0107931, filed on Nov. 2, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a thermal inkjet printhead having a low resistance wire.

2. Description of the Related Art

An inkjet printhead is a device for printing a predetermined color image by ejecting minute droplets of printing ink on a desired point of a printing paper. Inkjet printheads can be generally classified as to two types according to the ejection mechanism of ink droplets. A first type is a thermal inkjet printhead that ejects ink droplets using expansion force of ink bubbles that are created using a heat source, and a second type is a piezoelectric inkjet printhead that ejects inkjet droplets using a pressure created by the deformation of a piezoelectric element.

The ejection mechanism of ink droplets from the thermal inkjet printhead will be described in detail. When a pulse type current is applied to a heater composed of heating resistors, ink around the heater is instantly heated to approximately 300° C. due to the heat generated by the heater. Thus, the ink boils and thus, ink bubbles are generated. Then, the ink bubbles apply pressure to the ink filled in an ink chamber by expanding. As a result, ink near nozzles is ejected to the outside from the ink chamber through the nozzles in a droplet state.

FIG. 1 is a cross-sectional view illustrating a conventional thermal inkjet printhead. Referring to FIG. 1, the conventional thermal inkjet printhead includes a substrate 10 on which a plurality of material layers are formed, a chamber layer 20 stacked on the plurality of material layers, and a nozzle layer 30 stacked on the chamber layer 20. A plurality of ink chambers 22, in which ink that to be ejected is filled, are formed in the chamber layer 20. A plurality of nozzles 32 through which the ink is ejected are formed in the nozzle layer 30. An ink feed hole 11 for supplying ink to the ink chambers 22 is formed in the substrate 10. An insulating layer 12 for insulating a plurality of heaters 14 from the substrate 10 is formed on the substrate 10. The heaters 14 are formed on the insulating layer 12 to generate ink bubbles by heating the ink. Individual wires 16 that are electrically connected to the plurality of heaters 14 are formed on the heaters 14. The heaters 14 are formed of a heating resistor, for example, an alloy of tantalum-aluminum, tantalum-nitride, titanium-nitride, or tungsten-silicide. In FIG. 1, reference numeral 18 indicates a passivation layer for protecting the heaters 14 and individual wires 16, and reference numeral 19 indicates an anti-cavitation layer for protecting the plurality of heaters 14 from a cavitation force generated when ink bubbles disappear.

Although not illustrated in FIG. 1, a plurality of bonding pads 50 (as illustrated in FIGS. 2A and 2B) to which external voltages to drive the nozzles 32 are applied, and common wires 45 (as illustrated in FIGS. 2A and 2B) that are electrically connected to the bonding pads 50 are formed on the conventional thermal inkjet printhead. The individual wires 16 are electrically connected in parallel to each of the common wires 45. Each of the individual wires 16 is a metal layer having high electrical conductivity, and each of the common wires 45 is a metal layer having high electrical conductivity.

FIG. 2A is an equivalent circuit of the conventional thermal inkjet printhead when one of the nozzles 32 is driven. FIG. 2B is an equivalent circuit of the conventional thermal inkjet printhead when a plurality of the nozzles 32 are driven simultaneously. In FIGS. 2A and 2B, reference numeral 37 indicates a field effect transistor (FET) 37 for switching the operation of the nozzles 32. Vcc indicates an external voltage that is applied to the bonding pad 50, and $R_{cm}$, $R_{gm}$, $R_{heater}$ and $R_{FET}$ indicate resistances of the common wire 45, the individual wire, the heater 14, and the FET 37, respectively.

Referring to FIG. 2A, when one of the nozzles 32 of the conventional thermal inkjet printhead is driven, a majority of power supplied from the outside can be used by one of the corresponding heaters 14 since the resistance thereof is generally much larger than that of the individual wire 16 and that of the common wire 45. However, as depicted in FIG. 2B, when the plurality of nozzles 32 are driven simultaneously, and since resistances related to the nozzles 32 are connected in parallel, a sum of the resistances is very small. As a result, an influence of the resistances of the individual wires 16 and the common wires 45, (in particular, the common wires 45), is very large, and accordingly, power supplied to the heaters 14 is reduced. To compensate for the reduced power to the heaters 14, an external voltage Vcc that is applied to the bonding pads 50 must be increased. Also, as the number of nozzles 32 that are driven simultaneously increases, the external voltage Vcc that is applied to the bonding pads 50 must be further increased. However, the number of nozzles 32 driven simultaneously varies. Therefore, if the external voltage Vcc increases when one of the nozzles 32 is driven, an excessive voltage Vcc is applied to one of the corresponding heaters 14, thereby reducing an operational lifetime of one of the corresponding heaters 14.

To avoid the above-described problem, it is necessary to reduce resistances of the individual wires 16 and the common wires 45, and, in order to do so, thicknesses of the individual wires 16 and the common wires 45 must be increased. However, when the thickness of the individual wires 16 is increased, it is difficult to precisely form the heaters 14 in a desired shape by patterning of the thick individual wires 16.

SUMMARY OF THE INVENTION

The present general inventive concept provides a thermal inkjet printhead that can increase efficiency of power that is applied to heaters by reducing resistances of wires and can increase the number of nozzles that can be driven at the same time by the thermal inkjet printhead.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a thermal inkjet printhead including a plurality of bonding pads to which an external voltage is applied, a plurality of common wires respectively connected to the bonding pads, where each of the common wires includes a first metal layer and a first metal bump formed on the first metal layer, a plurality of individual wires respectively connected to the common wires, and heaters that are connected to each of the individual wires and generate ink bubbles by heating ink.

The first metal bump of each of the common wires may be formed of Ni formed on the first metal layer and Au formed on the Ni.

The individual wires may be connected in parallel to each of the common wires. Each of the individual wires may include a second metal layer and a second metal bump formed on the second metal layer. The second metal bump of each of the individual wires may be formed of Ni formed on the second metal layer and Au formed on the Ni.

The foregoing and/or other aspects and utilities of the present general inventive concept may also be achieved by providing a thermal inkjet printhead including a substrate in which an ink feed hole to supply ink is formed, a chamber layer which is stacked on the substrate and includes a plurality of ink chambers where ink is filled, a nozzle layer which is stacked on the chamber layer and includes a plurality of nozzles through which ink is ejected, a plurality of heaters that are formed on the substrate to apply heat to the ink to generate ink bubbles, individual wires which are formed on the heaters and are electrically connected to the heaters, a plurality of bonding pads which are formed on the substrate and to which an external voltage is applied, and common wires that are formed corresponding to the bonding pads to electrically connect the bonding pads respectively to the individual wires, wherein each of the common wires includes a first metal layer and a first metal bump formed on the metal layer.

The foregoing and/or other aspects and utilities of the present general inventive concept may also be achieved by providing a thermal inkjet printhead, including a bonding pad to which a voltage is applied, a common wire connected to the bonding pad, one or more individual wires connected to the common wire, and including a metal later and a metal bump formed on the metal layer, and one or more heaters connected to the respective individual wires to generate ink bubbles by heating ink according to the applied voltage.

The foregoing and/or other aspects and utilities of the present general inventive concept may also be achieved by providing a thermal inkjet printhead, including a bonding pad to which a voltage is supplied, a common wire connected to the bonding pad, and including a first metal layer and a first metal bump formed on the first metal layer, one or more individual wires connected to the common wire, and including a second metal layer and a second metal bump formed on the second metal layer, and one or more heaters connected to the respective individual wires to generate ink bubbles by heating ink according to the applied voltage.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
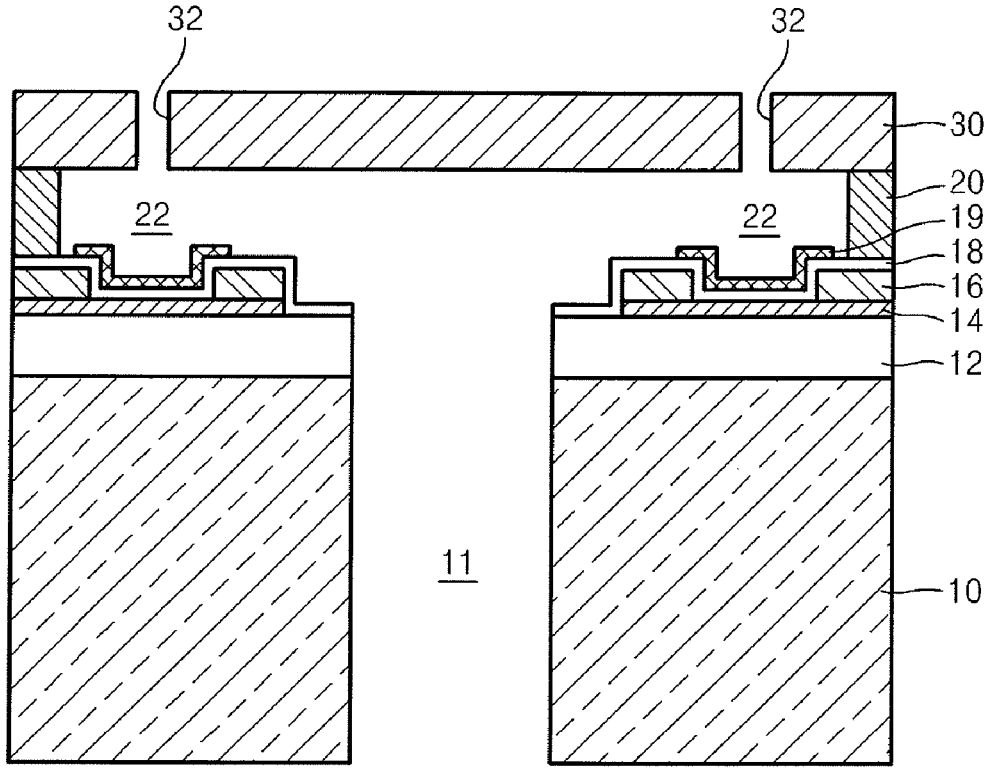
FIG. 1 (PRIOR ART)
FIG. 1 is a schematic cross-sectional view illustrating a conventional thermal inkjet printhead.
Figure 2A:
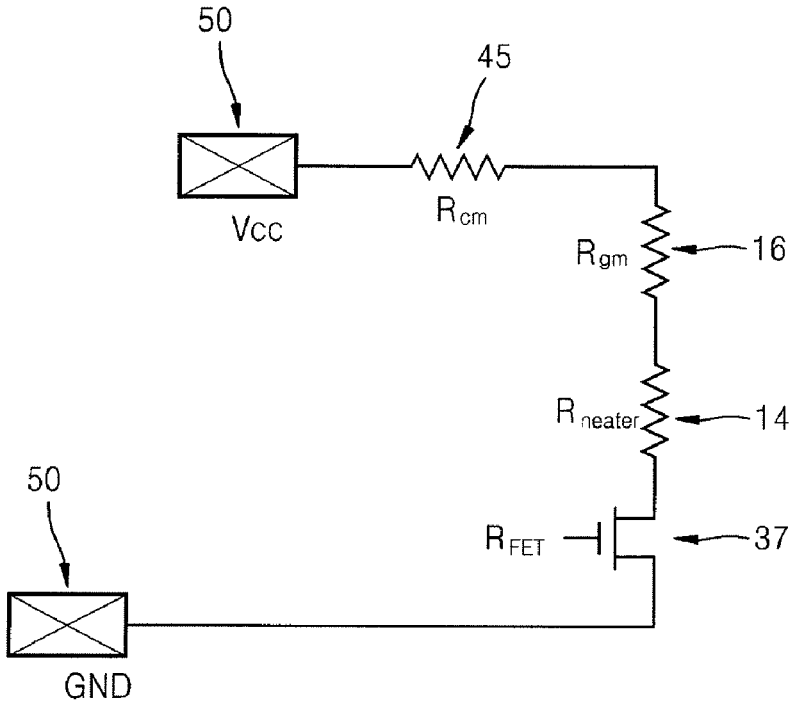
FIG. 2A (PRIOR ART)
FIG. 2A is an equivalent circuit of the conventional thermal inkjet printhead of FIG. 1, when one of a plurality of nozzles is driven.
Figure 2B:
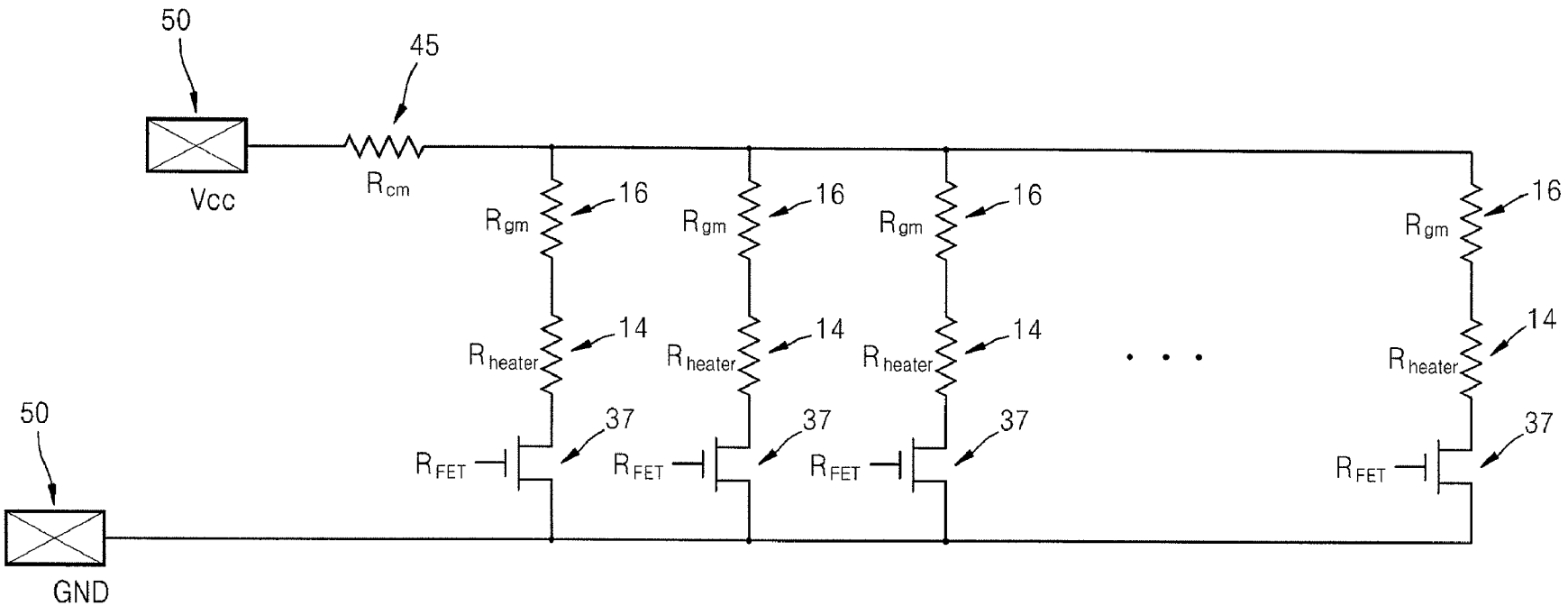
FIG. 2B (PRIOR ART)
FIG. 2B is an equivalent circuit of the conventional thermal inkjet printhead when a plurality of nozzles are driven.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
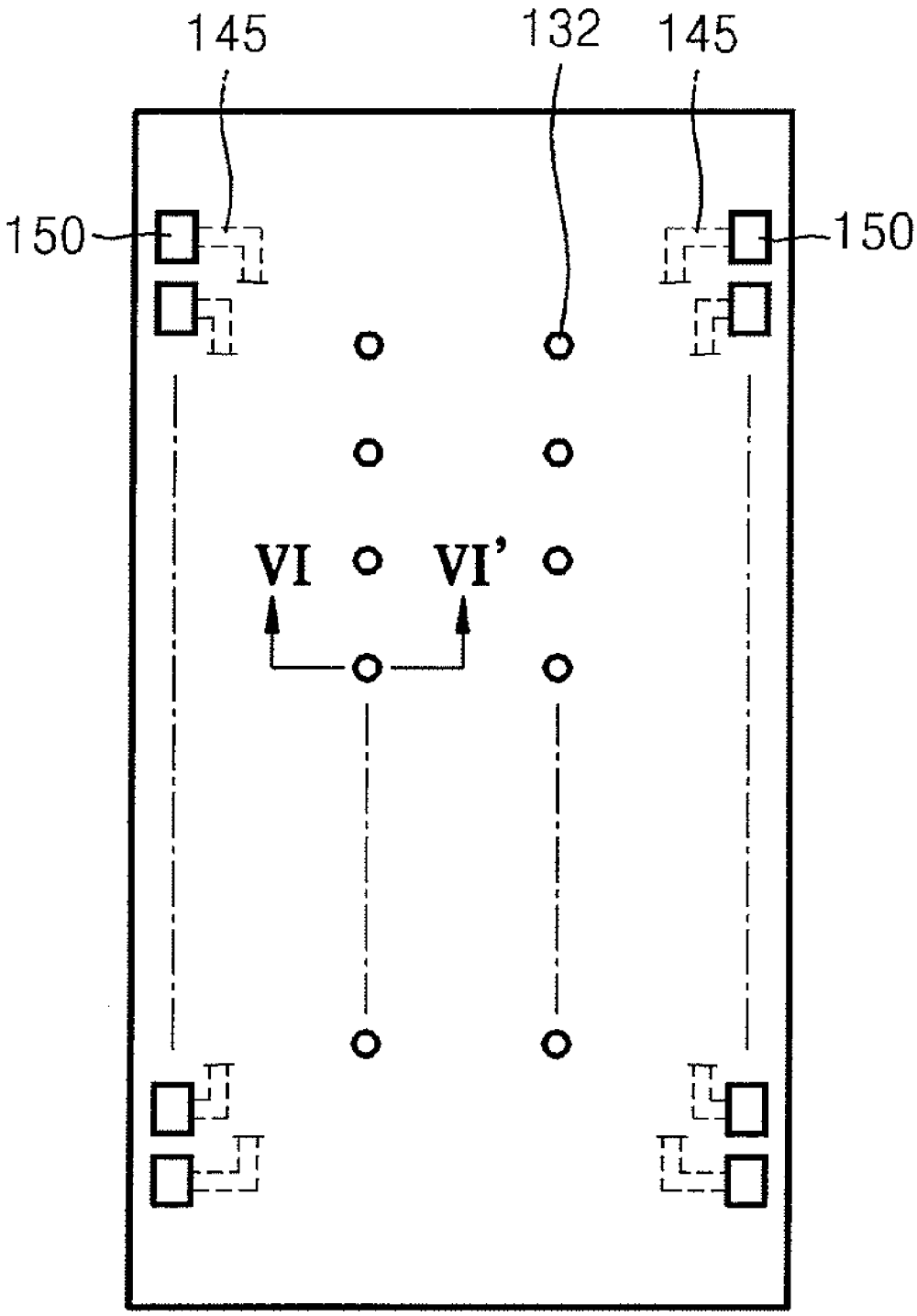
FIG. 3 is a schematic plan view illustrating a thermal inkjet printhead according to an embodiment of the present general inventive concept.

FIG. 3 is a schematic plan view illustrating a thermal inkjet printhead according to an embodiment of the present general inventive concept.

Figure 4:
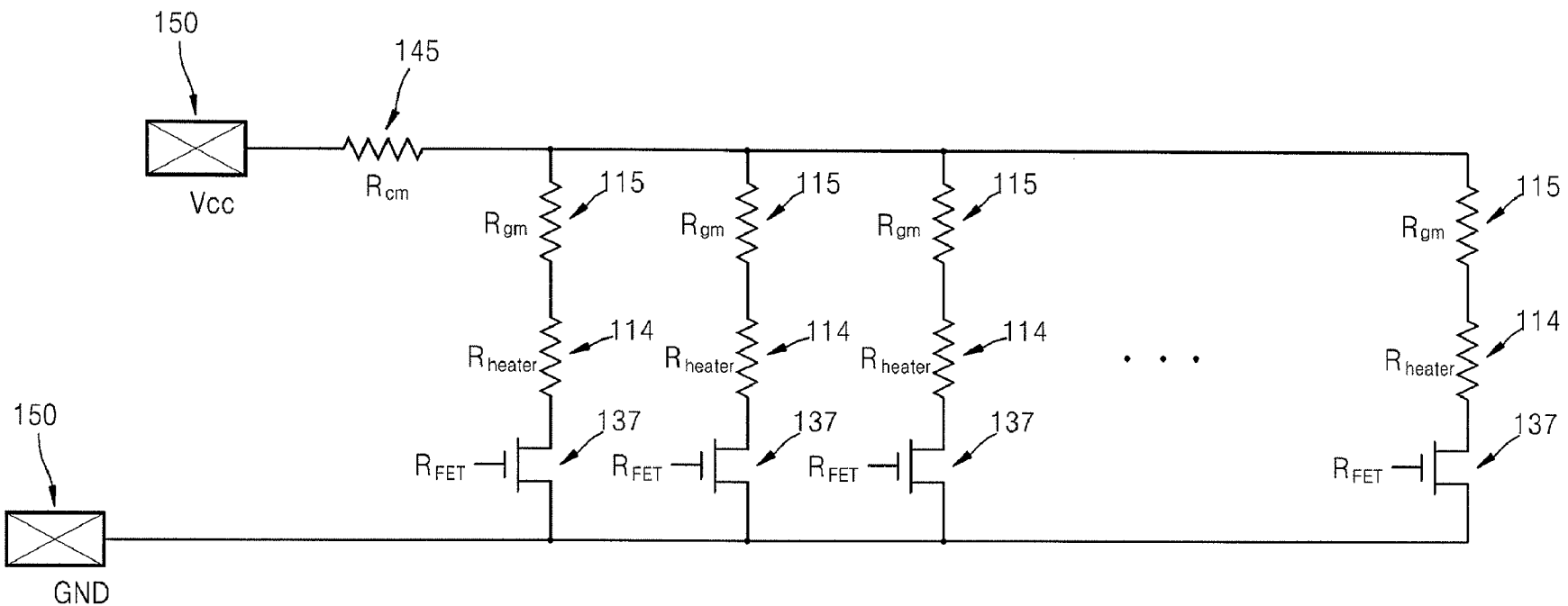
FIG. 4 is an equivalent circuit of the thermal inkjet printhead when a plurality of nozzles of the thermal inkjet printhead are driven simultaneously, according to an embodiment of the present general inventive concept.

Referring to FIG. 3, a plurality of nozzles 132 through which ink is ejected are formed in a predetermined pattern on the thermal inkjet printhead. A plurality of bonding pads 150, to which an external voltage is applied to drive the nozzles 132, are disposed on edges of the thermal inkjet printhead. Common wires 145 are electrically connected to each of the bonding pads 150, and a plurality of individual wires 115 of FIG. 4 are connected in parallel to each of the common wires 145. In FIG. 3, the nozzles 132 are arranged in a pair of rows, but the present general inventive concept is not limited thereto. That is, the nozzles 132 can be arranged in one row or a plurality of rows.

FIG. 4 is an equivalent circuit of the thermal inkjet printhead when a plurality of nozzles 132 are driven simultaneously, according to an embodiment of the present general inventive concept. In FIG. 4, reference numeral 137 indicates field effect transistors (FETs) 137 to switch an operation of the nozzles 132. Vcc indicates an external voltage that is applied to each of the bonding pads 150, and $R_{cm}$, $R_{gm}$, $R_{heater}$, and $R_{FET}$ respectively indicate resistances of the common wire 145, the individual wire 115, a heater 114, and the FET 137.

Referring to FIG. 4, the common wires 145 are respectively connected to the bonding pads 150. The plurality of individual wires 115 are connected in parallel to each of the common wires 145. The heaters 114 are respectively connected to the individual wires 115. Accordingly, the external voltage Vcc that is applied to each of the bonding pads 150 is applied to each of the heaters 114 through the common wires 145 and the individual wires 115.

Figure 5A:
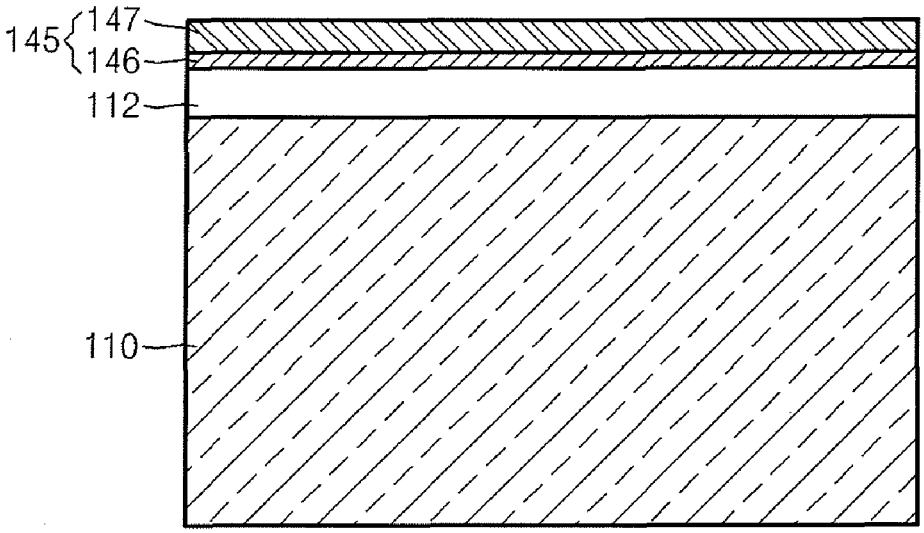
FIG. 5A illustrated a horizontal cross-sectional view of a common wire in a thermal inkjet printhead, according to an embodiment of the present general inventive concept
Figure 5B:
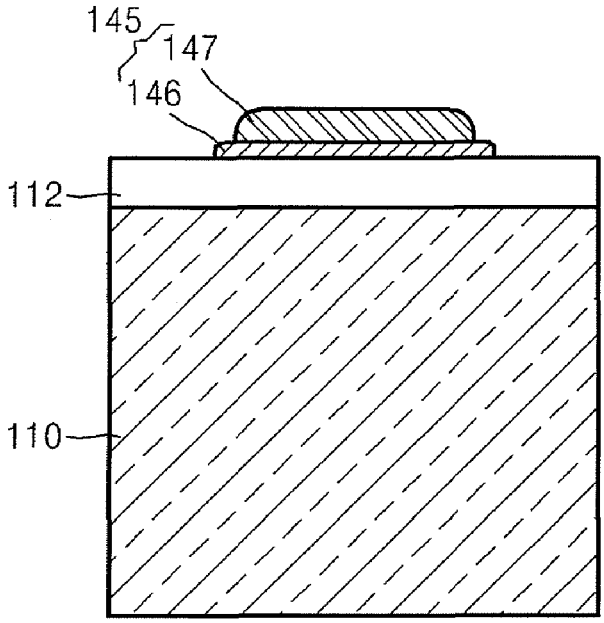
FIG. 5B illustrates a vertical cross-sectional view of a common wire in a thermal inkjet printhead, according to an embodiment of the present general inventive concept.
Figure 6:
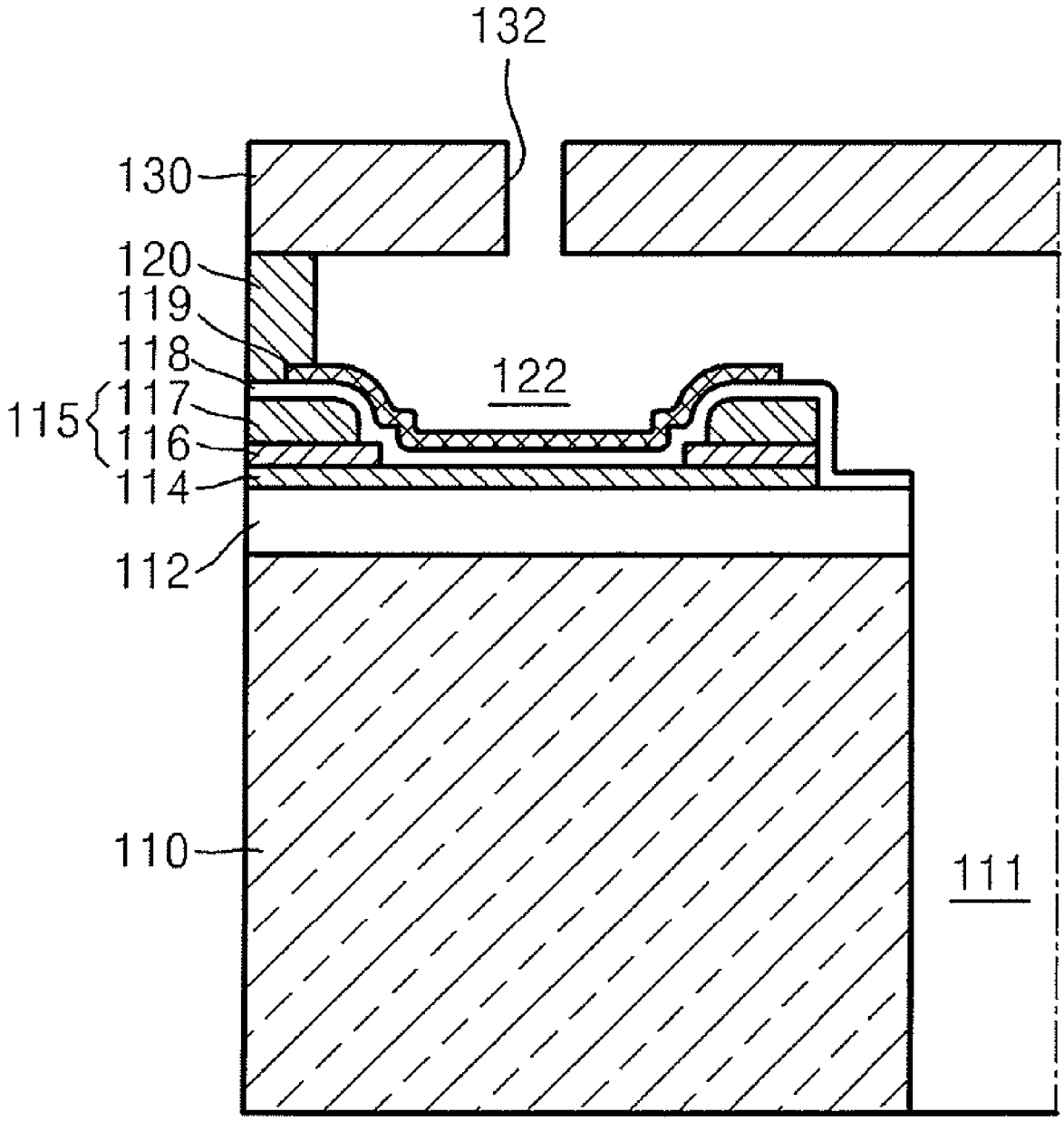
FIG. 6 is a cross-sectional view taken along line VI-VI' of FIG. 3, according to an embodiment of the present general inventive concept.

FIGS. 5A and 5B illustrate a horizontal cross-sectional view and a vertical cross-sectional view, respectively, of one of the common wires 145 in the thermal inkjet printhead of FIG. 4, according to an embodiment of the present general inventive concept. FIG. 6 is a cross-sectional view taken along line VI-VI' of FIG. 3, according to an embodiment of the present general inventive concept.

Referring to FIGS. 5A and 5B, the common wire 145 that electrically connects one of the bonding pads 150 to the individual wires 115 includes a first metal layer 146 which is formed on a substrate 110 and a first metal bump 147 which is formed on an upper surface of the first metal layer 146. The first metal bump 147 can be formed as a layer thicker than the first metal layer 146. It is possible that the first metal bump 147 may have a width narrower than a width of the first layer 146. Exterior corners of the first metal layer 146 and/or the first metal bump 147 may not have a rectangular shape, but a round shape. The first metal bump 147 may be formed on a flat surface of the first metal layer 146, between the round corners. The substrate 110 can be a silicon substrate, and an insulating layer 112 is formed on a surface of the substrate 110.

The first metal layer 146 can be a metal having high conductivity, for example, aluminum (Al), an aluminum (Al) alloy, gold (Au), or silver (Ag). The first metal bump 147 can be a metal such as nickel (Ni), and can be formed on an upper surface of the first metal layer 146. Additionally, gold (Au) can be formed on the nickel (Ni). However, the materials to form the first metal layer 146 and the first metal bump 147 according to the present general inventive concept are not limited thereto, and can be formed of various other materials.

In the prior art, a conventional common wire is only formed as a single metal layer. However, in the present embodiment, inclusion of the first metal layer 146 and the first metal bump 147 increases a thickness of the common wire 145. Therefore, resistance of the common wire 145 can be greatly reduced as compared to the conventional common wire of the prior art. Therefore, efficiency of power which is applied to the heaters 114 can be increased, and a margin of the external voltage Vcc to drive the nozzles 132 can be reduced. Also, a number of nozzles 132 that can be driven at the same time can be increased.

Referring to FIG. 6, a chamber layer 120 is formed on a substrate 110 on which a plurality of material layers are formed, and a nozzle layer 130 is stacked on the chamber layer 120. An ink feed hole 111 to supply ink is formed in the substrate 110. A plurality of ink chambers 122 which can contain ink to be supplied from the ink feed hole 111 are formed in the chamber layer 120. The nozzles 132 through which ink is ejected are formed in the nozzle layer 130.

The substrate 110 can mainly be a silicon substrate as described above with reference to FIGS. 5A and 5B. An insulating layer 112 to insulate heaters 114 from the substrate 110 is formed on an upper surface of the substrate 110. The insulating layer 112 can be formed of, for example, a silicon oxide. The heaters 114 to generate ink bubbles by heating the ink in the ink chambers 122 are formed on an upper surface of the insulating layer 112. The heaters 14 can be formed of a heating resistor, for example, an alloy of tantalum-aluminum, tantalum-nitride, titanium-nitride, or tungsten-silicide.

The individual wires 115 of FIG. 4 which apply current to the heaters 114 are formed on upper surfaces of the heaters 114. Each of the individual wires 115 can include a second metal layer 116 which is formed on the upper surface of the corresponding one of the heaters 114, and a second metal bump 117 which is formed on an upper surface of the second metal layer 116. The second metal bump 117 can be formed to be thicker than the second metal layer 116. It is possible that the second metal bump 117 may have a width narrower than a width of the second layer 116. Exterior corners of the second metal layer 146 and/or the second metal bump 117 may not have a rectangular shape, but a round shape. The second metal bump 147 may be formed on a flat surface of the second metal layer 146, between the round corners. The second metal layer 116 can be a metal having high conductivity like the first metal layer 146, for example, Al, an alloy of Al, Au, or Ag. The second metal bump 117 can also be formed of Ni, with Au being formed on the Ni, like the first metal bump 147 as described above. However, the second metal layer 116 and the second metal bump 117 according to the present general inventive concept are not limited thereto, that is, the second metal layer 116 and the second metal bump 117 can be formed of various metals.

The first metal layer 146 is connected to the second metal layer 116, and the first metal bump 147 is connected to the second metal bump since the first metal layer 146. The first metal bump 147, the second metal layer 117, and the second metal bump 117 are metal layers, the layers and bumps 146, 147, 116, and 117 are electrically connected to one another.

In the present embodiment, resistance of the individual wires 115 can be greatly reduced as compared to the prior art by constructing each of the individual wires 115 in two parts, such as the second metal layer 116 and the second metal bump 117. Meanwhile, as described above, each of the common wires 145 includes the first metal layer 146 and the first metal bump 147. Accordingly, the resistances of both the common wires 145 and the individual wires 115 can be reduced, the efficiency of power applied to each of the heaters 114 can be increased and the number of nozzles 132 that can be driven at the same time by the thermal inkjet printhead can be increased.

As illustrated in FIG. 6, a passivation layer 118 can further be formed on the upper surfaces of each of the individual wires 115 and each of the heaters 114. The passivation layer 118 prevents the heaters 114 and the individual wires 115 from being oxidized or corroded by contacting ink, and can be formed of, for example, silicon oxide or silicon nitride. An anti-cavitation layer 119 can further be formed on an upper surface of the passivation layer 118 that is located on each of the heaters 114. The anti-cavitation layer 119 protects each of the heaters 114 from cavitation pressure which is generated when ink bubbles disappear, and can be formed of, for example, tantalum (Ta).

As described above, according to the present general inventive concept, common wires and individual wires that electrically connect bonding pads and heaters are respectively made of a metal layer and a metal bump. Thus, resistances of the wires can be greatly reduced as compared to the prior art. Therefore, efficiency of power which is applied to each of the heaters can be increased, a margin of an external voltage Vcc to drive the nozzles can be reduced, and a number of nozzles that can be driven simultaneously can be increased.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A thermal inkjet printhead, comprising:

a plurality of bonding pads to which an external voltage is applied;

a plurality of common wires respectively connected to the bonding pads, comprising;

a first metal layer, and a first metal bump formed on the first metal layer;

a plurality of individual wires connected to each of the common wires; and heaters that are respectively connected to the individual wires to generate ink bubbles by heating ink.

2. The thermal inkjet printhead of claim 1, wherein the first metal bump of each of the common wires has a thickness greater than that of the first metal layer of each of the common wires.

3. The thermal inkjet printhead of claim 1, wherein the first metal bump of each of the common wires is formed of Ni formed on the first metal layer and Au formed on the Ni.

4. The thermal inkjet printhead of claim 1, wherein the individual wires are connected in parallel to each of the common wires.

5. The thermal inkjet printhead of claim 4, wherein each of the individual wires comprises:

a second metal layer; and a second metal bump formed on the second metal layer.

6. The thermal inkjet printhead of claim 5, wherein the second metal bump of each of the individual wires has a thickness greater than thicknesses of each of the second metal layers of each of the individual wires.

7. The thermal inkjet printhead of claim 5, wherein the second metal bump of each of the individual wires is formed of Ni formed on the second metal layer and Au formed on the Ni.

8. A thermal inkjet printhead, comprising:

a substrate including an ink feed hole to supply ink;

a chamber layer stacked on the substrate, comprising a plurality of ink chambers wherein ink is filled;

a nozzle layer stacked on the chamber layer, comprising a plurality of nozzles through which ink is ejected;

a plurality of heaters formed on the substrate to apply heat to the ink to generate ink bubbles;

individual wires formed on the heaters and are electrically connected to the heaters;

a plurality of bonding pads formed on the substrate and to which an external voltage is applied; and common wires formed corresponding to the bonding pads to electrically connect the bonding pads respectively to the individual wires, wherein each of the common wires comprises:

a first metal layer, and a first metal bump formed on the metal layer.

9. The thermal inkjet printhead of claim 8, wherein the first metal bump of each of the common wires has a thickness greater than that of the first metal layer of each of the common wires.

10. The thermal inkjet printhead of claim 8, wherein the first metal bump of each of the common wires is formed of Ni formed on the first metal layer and Au formed on the Ni.

11. The thermal inkjet printhead of claim 8, wherein the individual wires are connected in parallel to each of the common wires.

12. The thermal inkjet printhead of claim 11, wherein each of the individual wires comprises:

a second metal layer; and a second metal bump formed on the second metal layer.

13. The thermal inkjet printhead of claim 12, wherein the first metal bump of each of the common wires has a thickness greater than that of the first metal layer of each of the common wires.

14. The thermal inkjet printhead of claim 12, wherein the second metal bump of each of the individual wires is formed of Ni formed on the second metal layer and Au formed on the Ni.

15. The thermal inkjet printhead of claim 8, further comprising:

an insulating layer on an upper surface of the substrate.

16. The thermal inkjet printhead of claim 15, further comprising:

a passivation layer on upper surfaces of the individual wires and the heaters to prevent the heaters and the individual wires from being oxidized or corroded by the ink.

17. The thermal inkjet printhead of claim 16, further comprising:

an anti-cavitation layer to prevent the heaters from experiencing a cavitation force generated when ink bubbles disappear on an upper surface of the passivation layer that is located on the heaters.

18. A thermal inkjet printhead, comprising:

a bonding pad to which a voltage is applied;

a common wire connected to the bonding pad;

one or more individual wires connected to the common wire, and comprising a metal layer and a metal bump formed on the metal layer; and one or more heaters connected to the respective individual wires to generate ink bubbles by heating ink according to the applied voltage.

19. A thermal inkjet printhead, comprising:

a bonding pad to which a voltage is supplied;

a common wire connected to the bonding pad, and comprising a first metal layer and a first metal bump formed on the first metal layer;

one or more individual wires connected to the common wire, and comprising a second metal layer and a second metal bump formed on the second metal layer; and one or more heaters connected to the respective individual wires to generate ink bubbles by heating ink according to the applied voltage.

* * * * *